US009325093B2

(12) United States Patent
Endo et al.

(10) Patent No.: US 9,325,093 B2
(45) Date of Patent: Apr. 26, 2016

(54) CONNECTOR TERMINAL AND CONNECTOR INCLUDING THE SAME

(71) Applicant: DAI-ICHI SEIKO CO., LTD., Kyoto (JP)

(72) Inventors: Takayoshi Endo, Shizuoka (JP); Takehiko Osuga, Shizuoka (JP); Masaya Muta, Shizuoka (JP); Seiji Sasaki, Shizuoka (JP)

(73) Assignee: Dai-Ichi Seiko Co., Ltd. (JP)

( * ) Notice: Subject to any disclaimer, the term of this patent is extended or adjusted under 35 U.S.C. 154(b) by 0 days.

(21) Appl. No.: 14/749,343

(22) Filed: Jun. 24, 2015

(65) Prior Publication Data

US 2015/0380873 A1 Dec. 31, 2015

(30) Foreign Application Priority Data

Jun. 27, 2014 (JP) ..... 2014-133015

(51) Int. Cl.

| | |
|---|---|
| ***H01R 12/87*** | (2011.01) |
| ***H01R 12/89*** | (2011.01) |
| *H01R 4/18* | (2006.01) |
| *H01R 24/60* | (2011.01) |

(52) U.S. Cl.

CPC ..... *H01R 12/87* (2013.01); *H01R 4/185* (2013.01); *H01R 24/60* (2013.01)

(58) Field of Classification Search

CPC ..... H01R 12/87; H01R 12/89; H01R 12/85; H01R 12/82; H01R 23/684; H01R 12/79; H01R 23/6833

See application file for complete search history.

(56) References Cited

U.S. PATENT DOCUMENTS

| | | | | |
|---|---|---|---|---|
| 6,619,979 | B1 * | 9/2003 | Yu-Feng | H01R 12/79 439/260 |
| 6,644,995 | B1 * | 11/2003 | Jones | H01R 12/89 439/260 |
| 6,854,995 | B2 * | 2/2005 | Hotea | H01R 12/777 439/260 |
| 7,563,118 | B1 * | 7/2009 | McCauley | H01R 13/533 439/260 |
| 8,998,629 | B2 * | 4/2015 | Endo | H01R 12/72 439/260 |
| 2002/0064988 | A1 * | 5/2002 | Fujita | H01R 13/7034 439/260 |
| 2007/0212916 | A1 * | 9/2007 | Iijima | H01R 12/79 439/260 |
| 2013/0017702 | A1 * | 1/2013 | Kamiya | H01R 12/721 439/345 |
| 2015/0380873 | A1 * | 12/2015 | Endo | H01R 12/87 439/620.22 |

FOREIGN PATENT DOCUMENTS

| | | | |
|---|---|---|---|
| JP | 5-62972 | 8/1993 | H01R 13/05 |
| JP | 8-111255 | 4/1996 | H01R 13/11 |

(Continued)

*Primary Examiner* — Gary Paumen
(74) *Attorney, Agent, or Firm* — Hayes Soloway, P.C.

(57) ABSTRACT

There is provided a connector terminal to be inserted into a connector housing, the connector housing including a first space having an opening through which the connector terminal is inserted thereinto, and a second space being situated adjacent to the first space, the connector terminal including a terminal body and a resilient piece to be housed in the terminal body, the resilient piece defining a loop between ends thereof such that a gap is formed between the ends, the resilient piece being fixed at one of the ends thereof to the terminal body, the resilient piece including a contact portion resiliently protruding into the second space from the first space, the connector housing including a projection, the contact portion being caused to protrude into the second space from the first space when the other end of the resilient piece slides on the projection.

7 Claims, 15 Drawing Sheets

(56) References Cited

FOREIGN PATENT DOCUMENTS

| | | | |
|---|---|---|---|
| JP | 8-162230 | 6/1996 | H01R 23/68 |
| JP | 2003-45536 | 2/2003 | H01R 13/11 |
| JP | 3669268 | 4/2005 | H01R 13/42 |
| JP | 2011-100652 | 5/2011 | H01R 24/00 |
| JP | 2013-93133 | 5/2013 | H01R 13/42 |

* cited by examiner

CONNECTOR TERMINAL AND CONNECTOR INCLUDING THE SAME

BACKGROUND OF THE INVENTION

1. Field of the Invention

The present invention relates to a connector terminal used for electrical connection between devices equipped in an automobile and so on, more specifically, to a connector terminal used for a connector into which a circuit board having a terminal on a surface thereof is fit. The present invention relates further to a connector including the connector terminal.

2. Description of the Related Art

As a connector into which a circuit board having a terminal at a marginal area of a surface thereof is inserted, there is known a connector suggested in Japanese Patent No. 3669268.

FIG. 18 is a cross-sectional view of the connector suggested in Japanese Patent No. 3669268.

As illustrated in FIG. 18, the connector 100 is composed of a first housing 101 and a second housing 102 insertable into the first housing 101. The first housing 101 includes a circuit board 103 having a terminal 104 at a marginal area of a surface thereof. The second housing 102 includes a metal terminal 105 which makes contact with the terminal 104 when the second housing 102 is fit into the first housing 101.

The metal terminal 105 is formed by bending an electrically conductive sheet. The metal terminal 105 includes at a rear end thereof a wire connector 111 to which a wire W can be connected. The metal terminal 105 further includes a hollow connector 116 ahead of the wire connector 111, and a resilient contact piece 109 situated in the hollow connector 116 and bent into substantially a loop.

The first housing 101 includes at a bottom inner wall 106 thereof a pair of pushers 107 extending towards an opening of the first housing 101. Each of the pushers 107 includes at a distal free end thereof a guide surface 108 by which the resilient contact piece 109 of the metal terminal 105 is pushed.

In the connector 100, when the second housing 102 is inserted into the first housing 101, as illustrated in FIG. 19, the circuit board 103 enters the second housing 102 through an opening 112, and then, the pushers 107 enter spaces 114 through openings 113. As illustrated in FIG. 20, as the circuit board 103 forwards in the second housing 102, the guide surfaces 108 push a portion 115 of the resilient contact piece 109. Thus, the resilient contact piece 109 is resiliently deformed towards the circuit board 103. When the circuit board 103 is moved to a predetermined position, the first and second housings 101 and 102 are completely fit to each other, in which condition, the pushers 107 push first bending points 117 of the resilient contact piece 109 towards the circuit board 103 to thereby cause the resilient contact piece 109 to make contact, at a contact portion 118 thereof, with the terminal 104 of the circuit board 103.

In the above-mentioned conventional connector 100, when the second housing 102 is fit into the first housing 101, the pushers 107 compress the first bending portions 117 of the resilient contact piece 109 towards the circuit board 103 to thereby cause the resilient contact piece 109 to be resiliently deformed at its entirety towards the circuit board 103. Accordingly, it is necessary for the connector 100 to have in the metal terminal 105 both a space to house the resilient contact piece 109 therein and a space to house the pushers 107 therein. Consequently, the connector 100 is accompanied with a problem in that the terminal metal 105 is unavoidably necessary to be large in a size, and accordingly, the connector 100 housing the terminal metal 105 therein is unavoidably necessary to be large in a size.

SUMMARY OF THE INVENTION

In view of the above-mentioned problems in the conventional connector, it is an object of the present invention to provide a down-sized connector terminal used for a connector into which a circuit board having a terminal on a surface thereof is fit.

It is further an object of the present invention to provide a connector including the connector terminal.

In one aspect of the present invention, there is provided a connector terminal to be inserted into and housed in a connector housing, the connector housing including a first space having an opening through which the connector terminal is inserted thereinto, and a second space into which a circuit board is fit, the second space being situated adjacent to the first space, the connector terminal including a terminal body having an opening at a front in a first direction in which the connector terminal is inserted into the first space, and a resilient piece to be housed in the terminal body, the resilient piece defining a loop between ends thereof such that a gap is formed between the ends thereof, the resilient piece being housed in the terminal body such that the gap faces the opening of the terminal body, the resilient piece being fixed at one of the ends thereof to the terminal body, the resilient piece including a contact portion resiliently protruding into the second space from the first space, the connector housing including a projection projecting in a second direction opposite to the first direction, and being insertable into the terminal body through the opening of the terminal body, the connector housing being formed with an opening between the first and second spaces, the contact portion being able to pass through the opening, the resilient piece including a sliding portion at the other end thereof, the sliding portion being slidable on the projection when the connector terminal is inserted into the first space, the contact portion being caused to protrude into the second space from the first space through the opening when the sliding portion slides on the projection.

In the connector terminal in accordance with the present invention, when the connector terminal is inserted into the first space through the opening, the projection of the connector housing enters the resilient piece through the opening of the terminal body and further through the gap of the resilient piece. The projection makes contact with the other end of the resilient piece, and further enters the resilient piece while the other end of the resilient piece slides on the projection. As a result, the contact portion of the resilient piece is caused to protrude into the second space from the first space through the opening. Thus, the contact portion is in a condition that the contact portion can make contact with a circuit board to be inserted into the second space. When a circuit board is actually inserted into the second space, the contact portion makes contact with a terminal of the circuit board.

For instance, the resilient piece may be designed to include a curved first portion, a second portion extending from one of ends of the first portion and having a free distal end, and a third portion extending from the other end of the first portion and having a free distal end, the contact portion being formed at the third portion so as to outwardly protrude in a V-shape, the third portion being formed such that a part thereof including the free distal end thereof is inclined towards the second portion so as to form a gap between the free distal end thereof and the free distal end of the second portion.

It is preferable that the part of the third portion including the free distal end thereof be curved in a V-shape.

It is preferable that the second portion include a curved portion between a distal end thereof and the first portion, the curved portion protruding towards the third portion. The curved portion disperses a stress to be generated in the resilient piece when the resilient, piece is deformed, ensuring that the resilient piece can be prevented from being plastically deformed when a circuit board is inserted into the second space.

It is preferable that either one of the terminal body and the resilient piece be formed with a raised portion, the raised portion of the terminal body being in facing relation with the one of ends of the resilient piece when the resilient piece is fixed at the one of the ends thereof to the terminal body, the raised portion of the resilient piece being in facing relation with the terminal body when the resilient piece is fixed at the one of the ends thereof to the terminal body.

The above-mentioned raised portion enables point-contact between the raised portion and the terminal body or the resilient piece in place of plane-contact between the terminal body and the resilient piece when the resilient piece and the terminal body make contact with each other.

It is preferable that the terminal body include a stopper restricting movement of the resilient piece in the second direction.

The stopper restricts the retreat of the first portion of the resilient piece, that is, the movement of the first portion in the second direction, when a circuit board is inserted into the second space, preventing the resilient piece from being buckled.

In another aspect of the present invention, there is provided a connector including a connector housing and a connector terminal as mentioned above, the connector housing including a first space having an opening through which the connector terminal is inserted thereinto, and a second space into which a circuit board is fit, the second space being situated adjacent to the first space, the connector terminal being inserted into and housed in the first space through the opening, the connector terminal including a terminal body having an opening at a front in a first direction in which the connector terminal is inserted into the first space, and a resilient piece to be housed in the terminal body, the resilient piece defining a loop between ends thereof such that a gap is formed between the ends thereof, the resilient piece being housed in the terminal body such that the gap faces the opening of the terminal body, the resilient piece being fixed at one of the ends thereof to the terminal body, the resilient piece including a contact portion resiliently protruding into the second space from the first space, the connector housing including a projection projecting in a second direction opposite to the first direction, and being insertable into the terminal body through the opening of the terminal body, the connector housing being formed with an opening between the first and second spaces, the contact portion being able to pass through the opening, the other end of the resilient piece being slidable on the projection when the connector terminal is inserted into the first space, the contact portion being caused to protrude into the second space from the first space through the opening when the other end thereof slides on the projection.

The advantages obtained by the aforementioned present invention is described hereinbelow.

When the connector terminal is inserted into the first space through the opening, the projection of the connector housing enters the resilient piece through the opening of the terminal body and further through the gap of the resilient piece. The projection makes contact with the other end of the resilient piece, and further enters the resilient piece while the other end of the resilient piece slides on the projection. Thus, the contact portion of the resilient piece is caused to protrude into the second space from the first space through the opening. Thus, the contact portion is in a condition that the contact portion can make contact with a circuit board to be inserted into the second space. When a circuit board is actually inserted into the second space, the contact portion makes contact with a terminal of the circuit board.

If only a space for housing the resilient piece is formed within the terminal body, a space for inserting the projection of the connector housing can be formed in the former mentioned space. This ensures to down-size the connector terminal and the connector in which the connector terminal is housed.

The curved portion formed at the second portion between the distal end of the second portion and the first portion prevents the resilient piece from being plastically deformed when a circuit board is inserted into the second space, and accordingly, provides enhanced durability to the connector terminal.

The raised portion formed at the terminal body or the resilient piece enables point-contact between the raised portion and the terminal body or the resilient piece in place of plane-contact between the terminal body and the resilient piece when the resilient piece and the terminal body make contact with each other, which enhances reliability in the contact between the terminal body and the resilient piece.

The stopper included in the terminal body restricts the retreat of the first portion of the resilient piece, that is, the movement of the first portion in the second direction, when a circuit board is inserted into the second space, preventing the resilient piece from being buckled, ensuring enhancement in reliability to electrical connection between the connector terminal and a circuit board.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

Figure 1:
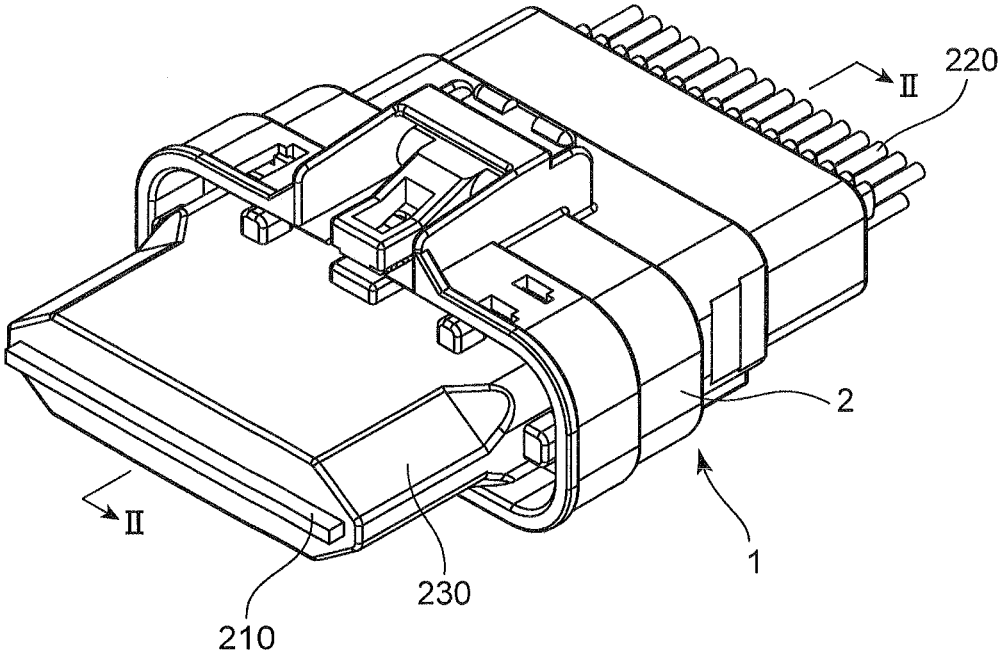
FIG. 1 is a perspective view of a connector in accordance with a preferred embodiment of the present invention.
Figure 2:
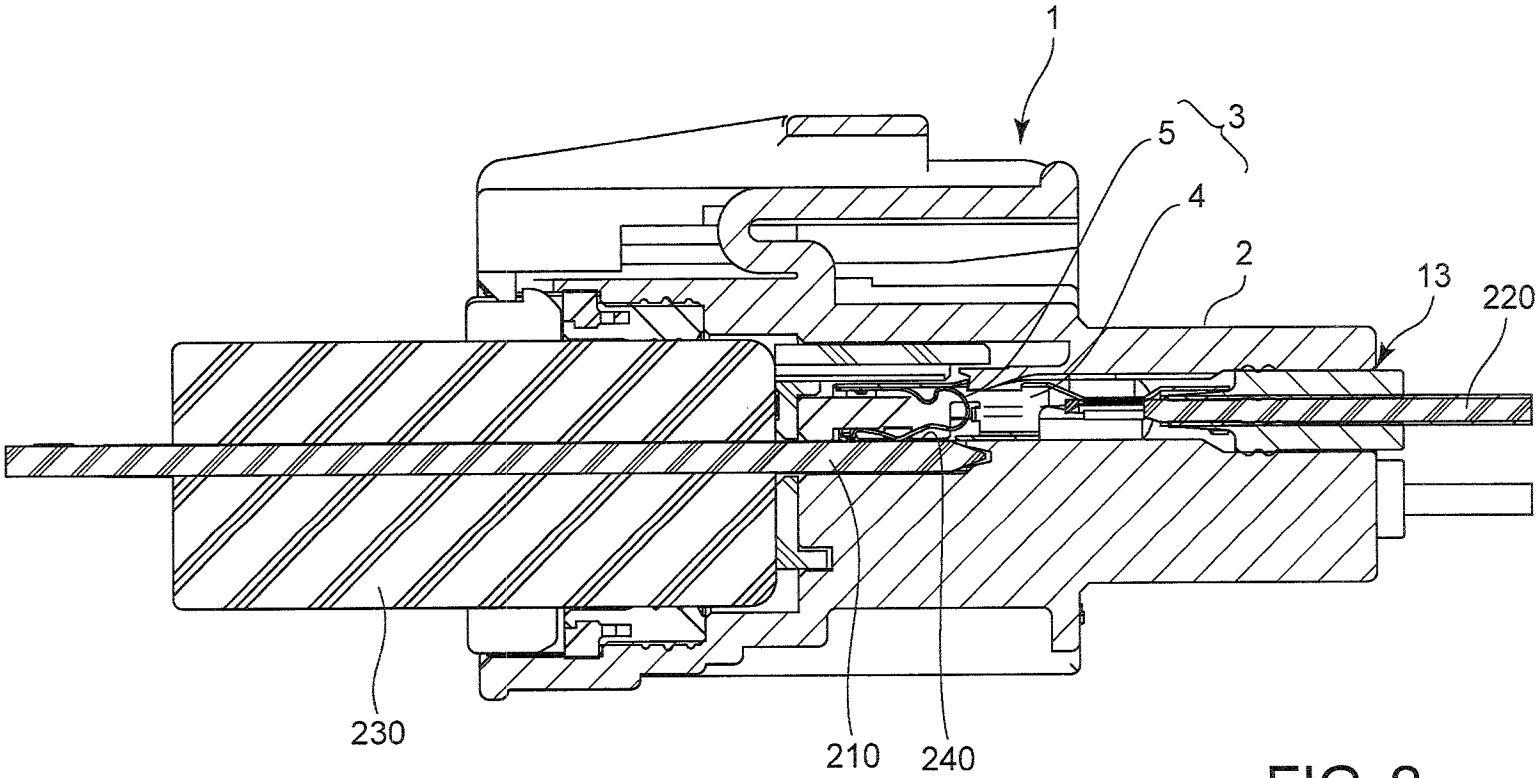
FIG. 2 is a cross-sectional view of a connector housing taken along the line II-II shown in FIG. 1.
Figure 3:
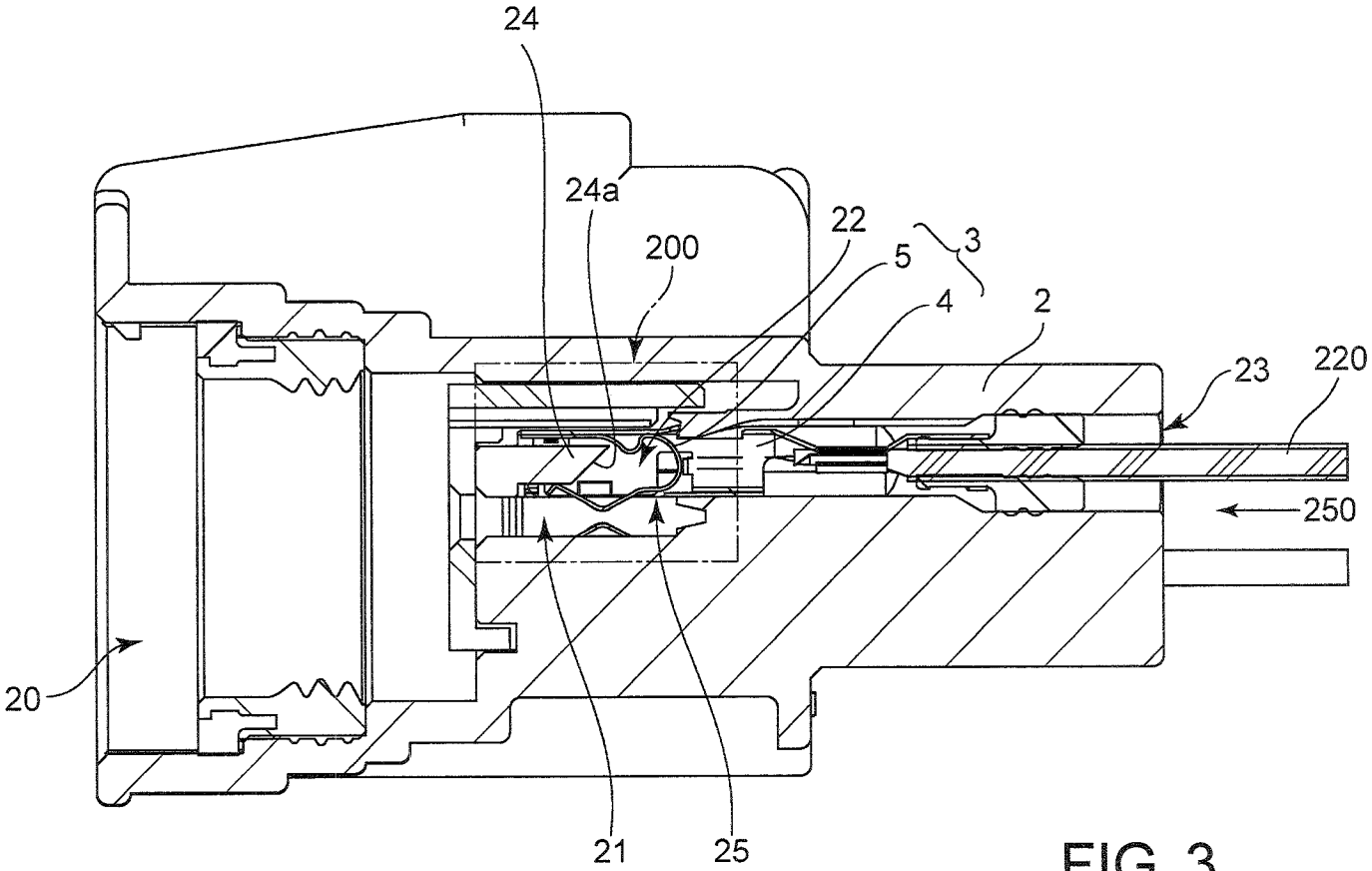
FIG. 3 is a cross-sectional view of the connector housing and the connector terminal, taken along the line II-II shown in FIG. 1.
Figure 4:
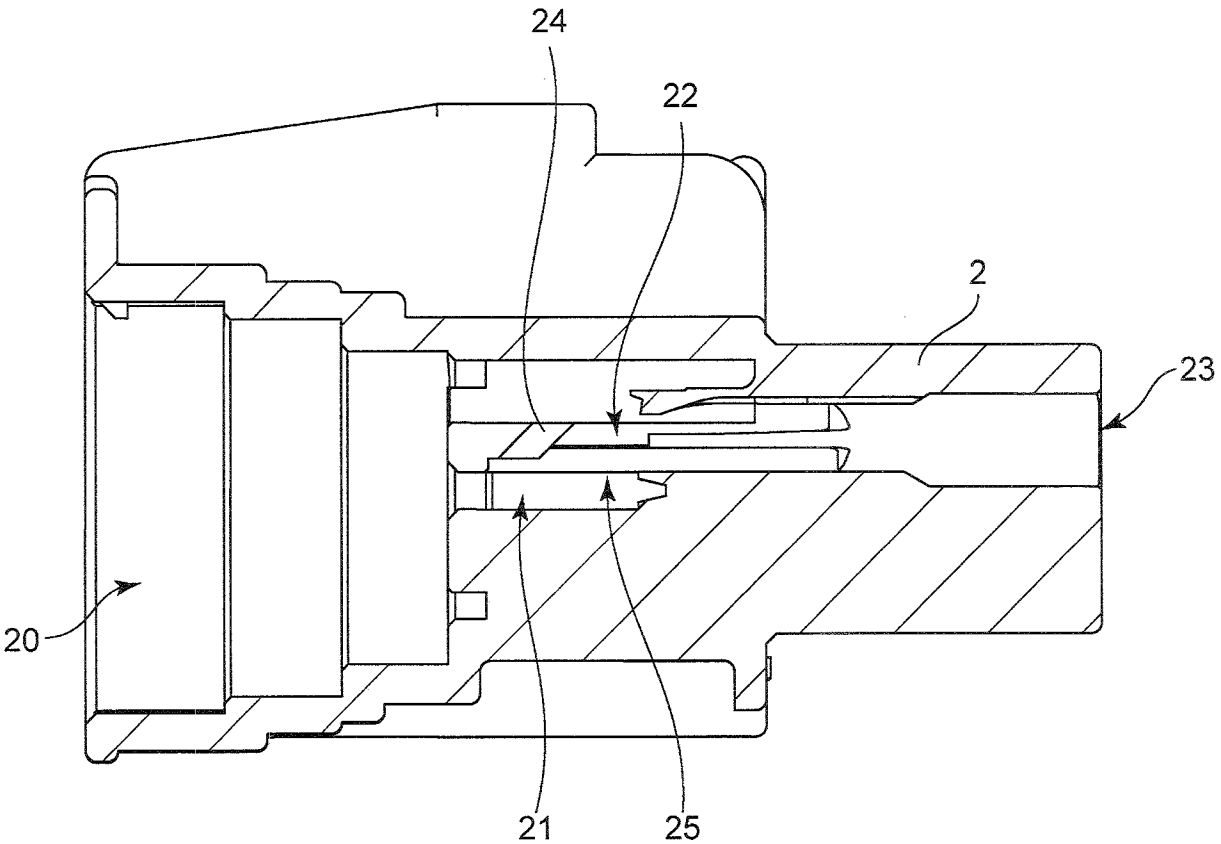
FIG. 4 is a cross-sectional view only of the connector housing, taken along the line II-II shown in FIG. 1.
Figure 5:
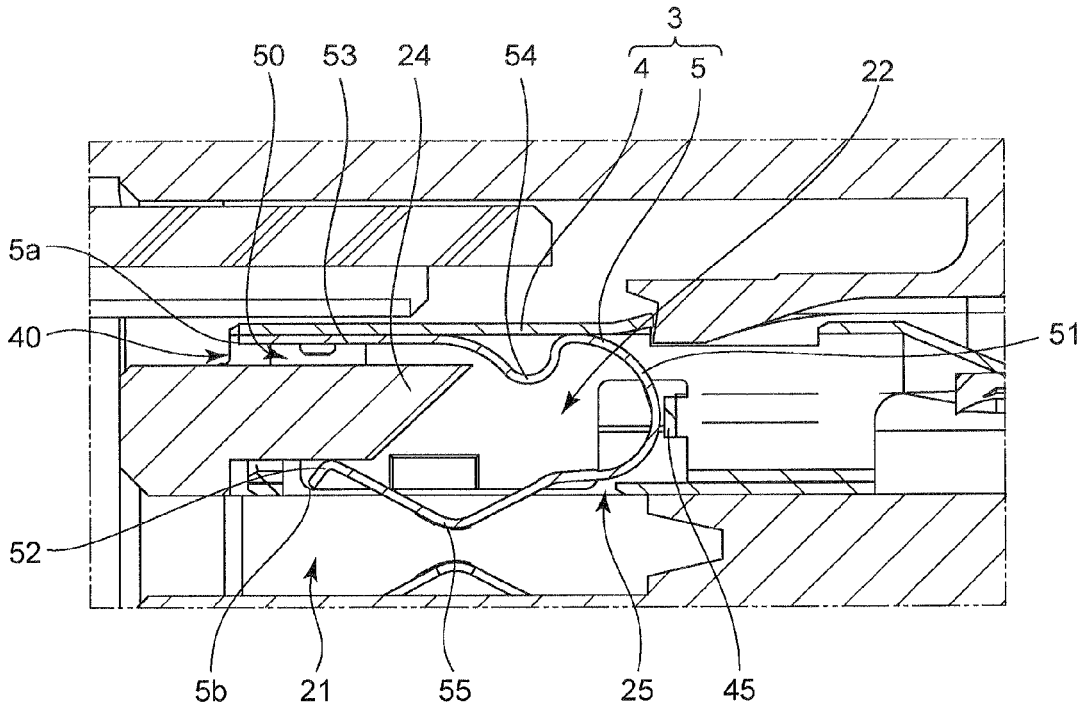
FIG. 5 is an enlarged view of a portion 200 shown in FIG. 3.
Figure 6:
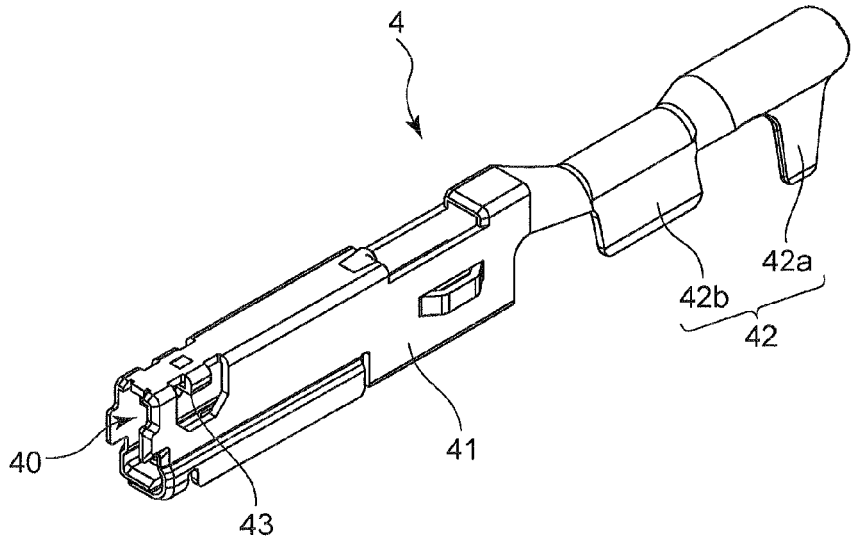
FIG. 6 is a perspective view of a terminal body illustrated in FIG. 3.
Figure 7:
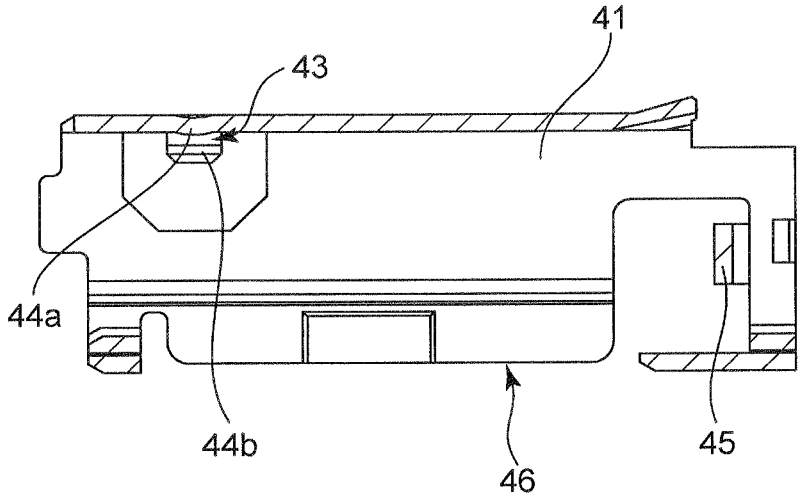
FIG. 7 is a cross-sectional view of a sheath portion of the terminal body illustrated in FIG. 3.
Figure 8:
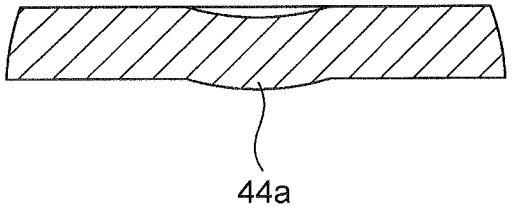
FIG. 8 is an enlarged cross-sectional view of a protrusion illustrated in FIG. 7.
Figure 9:
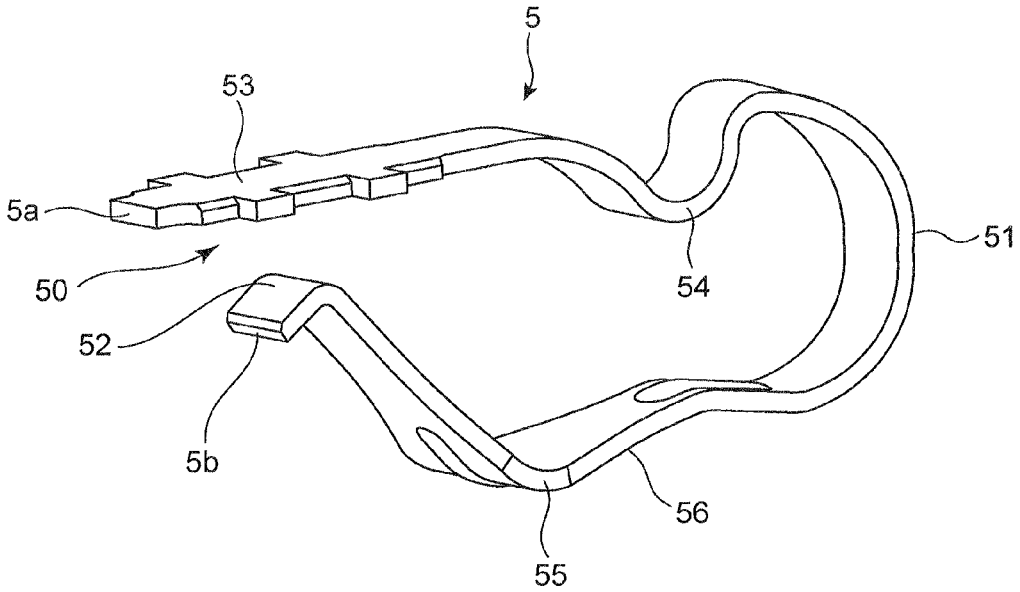
FIG. 9 is a perspective view of a resilient piece illustrated in FIG. 3.
Figure 10:
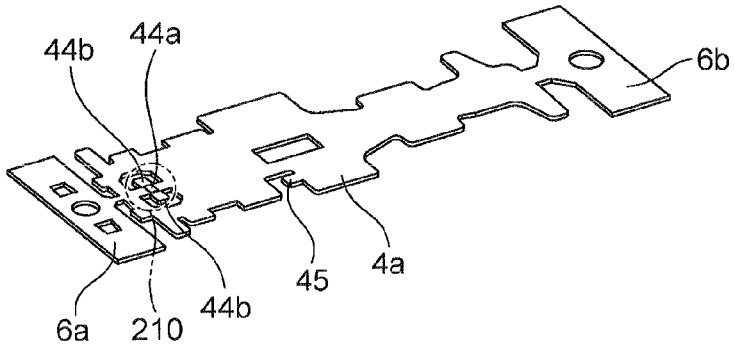
FIG. 10 is a perspective view of a metal sheet from which the terminal body illustrated in FIG. 6 is fabricated.
Figure 11:
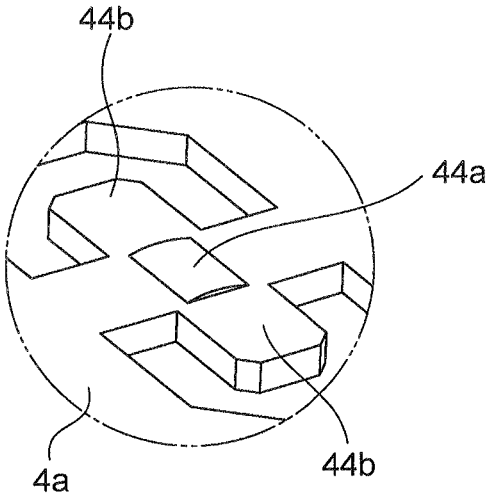
FIG. 11 is an enlarged view of a portion 210 shown in FIG. 10.

FIG. 1 is a perspective view of a connector in accordance with a preferred embodiment of the present invention, FIG. 2 is a cross-sectional view of a connector housing taken along the line II-II shown in FIG. 1, FIG. 3 is a cross-sectional view of the connector housing and the connector terminal, taken along the line II-II shown in FIG. 1, FIG. 4 is a cross-sectional view only of the connector housing, taken along the line II-II shown in FIG. 1, FIG. 5 is an enlarged view of a portion 200 shown in FIG. 3, FIG. 6 is a perspective view of a terminal body illustrated in FIG. 3, FIG. 7 is a cross-sectional view of a sheath portion of the terminal body illustrated in FIG. 3, FIG. 8 is an enlarged cross-sectional view of the protrusion illustrated in FIG. 7, FIG. 9 is a perspective view of the resilient piece illustrated in FIG. 3, FIG. 10 is a perspective view of a metal sheet from which the terminal body illustrated in FIG. 6 is fabricated, and FIG. 11 is an enlarged view of a portion 210 shown in FIG. 10.

As illustrated in FIGS. 1 and 2, a connector 1 in accordance with the embodiment of the present invention is a so-called card edge connector into which a circuit board 210 on which a terminal 240 is formed at a marginal area thereof is inserted. The circuit board 210 is fixed in a housing 230. The connector 1 is comprised of a connector housing 2, and a connector terminal 3 which makes electrical contact with the terminal 240 of the circuit board 210. A cable 220 is connected to the connector terminal 3.

As illustrated in FIGS. 3 to 5, the connector housing 2 includes a hood 20 opened at an end thereof for allowing the housing 230 to be inserted therethrough. The hood 20 is formed with a first space 22 into which the connector terminal 3 is inserted, and a second space 21 into which the housing 230 fixing the circuit board 210 therein is inserted. The first and second spaces 22 and 21 are situated adjacent to each other. The connector housing 2 includes, on an opposite side to the hood 20 about the second space 21, an opening 23 through which the connector terminal 3 is inserted into the first space 22.

The connector terminal 3 includes a terminal body 4 as a first terminal part, illustrated in FIG. 6, and a resilient piece 5 as a second terminal part illustrated in FIG. 9.

The terminal body 4 is designed to have an opening 40 at a front end in a direction 250 (see FIG. 3) in which the connector terminal 3 is inserted into the connector housing 2.

As illustrated in FIG. 9, the resilient piece 5 is formed bent at an end thereof such that there is formed a gap 50 between opposite ends 5*a* and 5*b*. The resilient piece 5 is housed in the terminal body 4 such that the gap 50 faces the opening 40 of the terminal body 4.

The connector terminal 3 is inserted into the first space 22 through the opening 23, and kept housed in the first space 22. The connector housing 2 is formed with a plurality of the first spaces 22 arranged vertically in two zigzag rows, and further with a plurality of the second spaces 21 arranged above and below the vertical two columns of the first spaces 22. The connector terminal 3 is inserted into each of the first spaces 22.

As illustrated in FIG. 5, the connector housing 2 includes a projection 24 in the first space 22. The projection 24 is located ahead of the connector terminal 3, and projects towards the gap 50 of the resilient piece 5 of the terminal body 4 inserted into the first space 22. The projection 24 has a tapered top surface 24*a*. The top surface 24*a* inclines in such a way that a side of the projection 24 located remoter from the second space 21 than the other side 24*b* (see FIG. 16A) is situated closer to the opening 23.

The connector housing 2 is formed further with an opening 25 between the first and second spaces 22 and 21 so as to allow the resilient piece 5 to partially protrude into the second space 21.

The terminal body 4 is formed by bending an electrically conductive metal sheet 4*a* illustrated in FIG. 10. The metal sheet 4*a* is cut out in advance into a predetermined shape. Though FIG. 10 illustrates only a portion of the metal sheet 4*a* for fabricating a single terminal body 4, portions of the metal sheet 4*a* for fabricating a plurality of the terminal bodies 4 are connected to one another through carriers 6*a* and 6*b* located at opposite ends of each of the terminal bodies 4.

As illustrated in FIG. 6, the terminal body 4 includes a sheath portion 41 in which the resilient piece 5 is housed, and a bundle portion 42 in which the cable 220 is fixed in a compressed condition. The bundle portion 42 includes a first section 42*a* for fixing an outer electrical insulator of the cable 220, and a second section 42*b* for holding the cable 220 to allow the cable 220 to make electrical contact with the sheath portion 41.

The terminal body 4 further includes a fixing section 43 for fixing the resilient piece 5 in the sheath portion 41 to allow the resilient piece 5 to make electrical connection with the sheath portion 41. As illustrated in FIGS. 6 and 7, the fixing section 43 includes a projecting portion 44*a* facing the resilient piece 5, and a fixing portion 44*b* formed by cutting out a sidewall of the terminal body 4. The resilient piece 5 is fixed between the projecting portion 44*a* and the fixing portion 44*b* by collapsing the fixing portion 44*b* onto the resilient piece 5.

The sheath portion 4 further includes a stopper 45 at a rear thereof for preventing retreat of the resilient piece 5. The stopper 45 is formed by making a cut-out in a sidewall of the terminal body 4, and perpendicularly bending the sidewall inwardly of the terminal body 4. The stopper 45 is situated so as to make abutment with or in the vicinity of a curved or arcuate first portion 51 (see FIG. 9) of the resilient piece 5. The terminal body 4 is formed, at a wall facing the fixing section 43, with an opening 46 (see FIG. 7) such that the resilient piece 5 is able to protrude into the second space 22 through the opening 25 and further through the opening 46.

The projecting portion 44*a* is formed by punching the metal sheet 4*a*. The projecting portion 44*a* may be formed at the resilient piece 5 instead of the terminal body 4. In brief, the projecting portion 44*a* is designed to face the resilient piece 5 when the terminal body 4 includes the projecting portion 44*a*, whereas the projecting portion 44*a* is designed to face the terminal body 4 when the resilient piece 5 includes the projecting portion 44*a*. The resilient piece 5 may be fixed to the terminal body 4 by welding the resilient piece 5 to the terminal body 4 in place of deforming the fixing portion 44*b*.

As illustrated in FIG. 9, the resilient piece 5 includes the curved or arcuate first portion 51, a second portion 53 extending from one of ends of the first portion 51 and having a free distal end 5*a*, and a third portion 56 extending from the other end of the first portion 51 and having a free distal end 5*b*.

The distal ends 5*a* and 5*b* are spaced away from each other to thereby form the above-mentioned gap 50 therebetween.

The second portion 53 includes a curved portion 54 between the distal end 5*a* and the first portion 51. The curved portion 54 protrudes in an arcuate form towards the third portion 56.

The second portion 53 is formed flat between the distal end 5*a* and the curved portion 54.

The third portion 56 includes a contact portion 55 resiliently protruding into the second space 21 from the first space 22. The contact portion 55 outwardly protrude in a V-shape.

The third portion 56 includes a part 52 including the free distal end 5*b* thereof. The part 52 is bent in a V-shape to thereby protrude towards the second portion 53. The part 52 acts as a sliding portion slidable on the top surface 24*a* of the projection 24.

As illustrated in FIG. 9, the resilient piece 5 is formed by bending a metal sheet such that the two free distal ends 5*a* and 5*b* form the gap 50 therebetween, and that the first portion 51 protrudes in an arcuate from towards a rear of the connector terminal 3. The part or the sliding portion 52 including the distal end 5*b* facing the distal end 5*a* at which the resilient piece 5 is fixed to the terminal body 4 through the fixing section 43 has a reverse V-shape such that the sliding portion 52 is able to smoothly slide on the top surface 24*a* of the projection 24 when the connector terminal 3 is inserted into the first space 22.

The second portion 53 is formed flat so as to make close contact with an inner wall of the terminal body 4.

Figure 12:
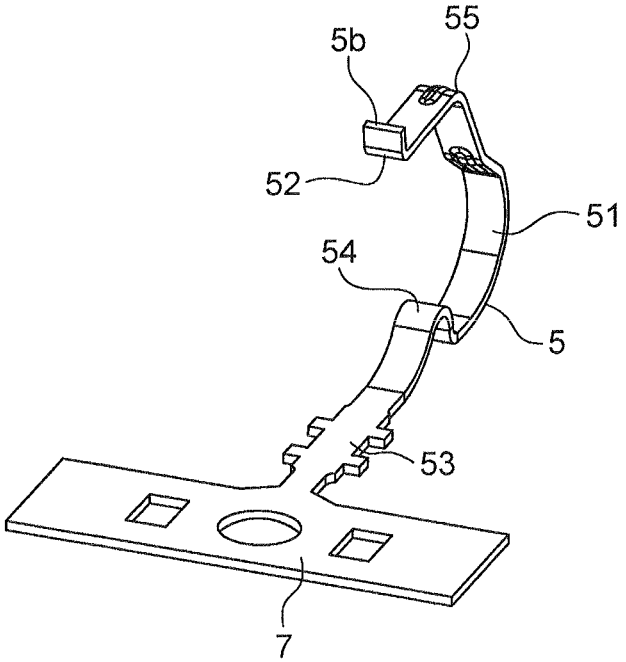
FIG. 12 is a perspective view of the resilient piece before being assembled into the terminal body.
Figure 13:
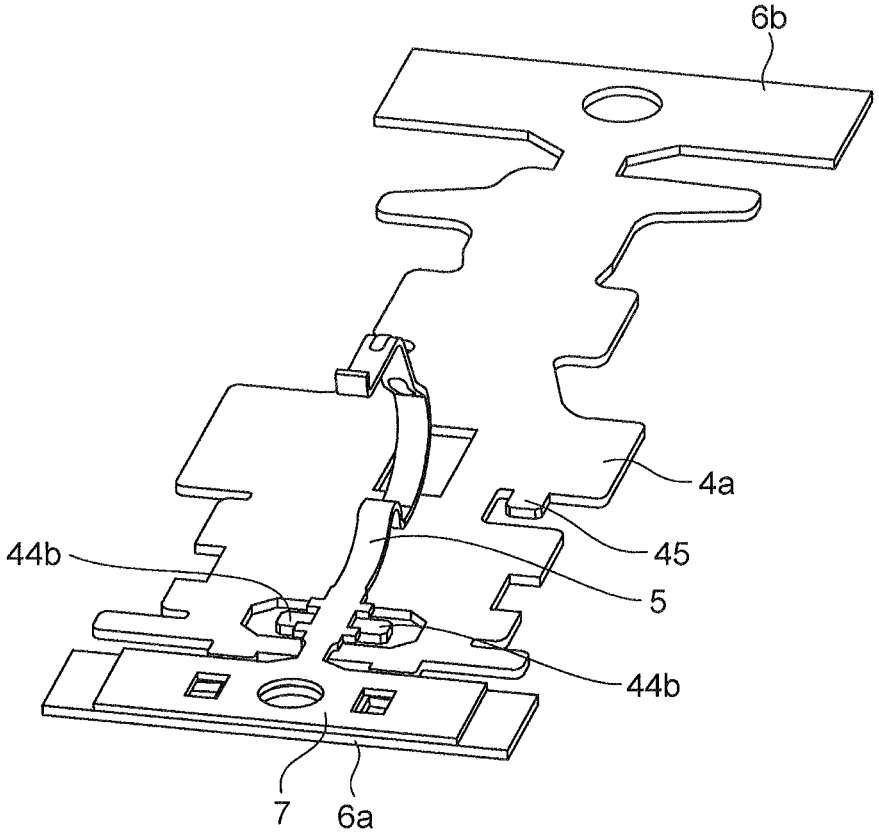
FIG. 13 is a perspective view of the resilient piece put on a metal sheet.
Figure 14:
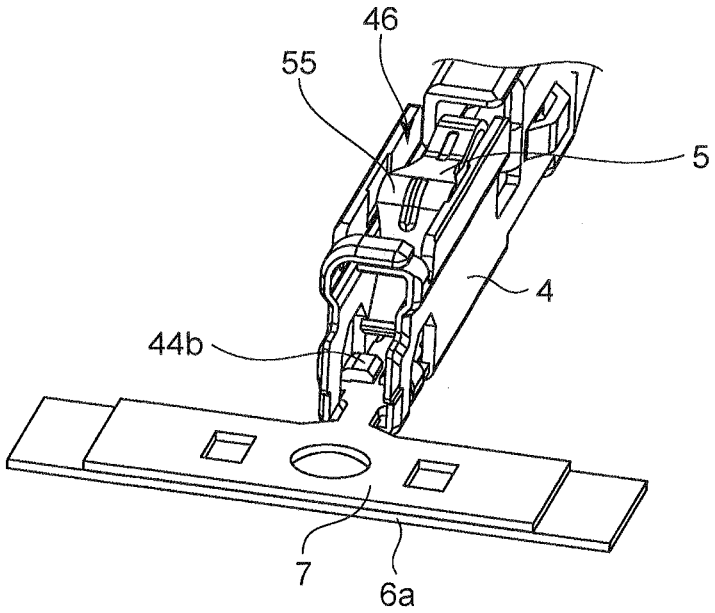
FIG. 14 is a perspective view that illustrates the connector terminal being assembled.

Hereinbelow is explained a process of fabricating the connector terminal 3 with reference to FIGS. 12 to 15. FIG. 12 is a perspective view of the resilient piece 5 before assembly into the terminal body 4, FIG. 13 is a perspective view of the resilient piece 5 put on the metal sheet 4*a*, FIG. 14 illustrates the connector terminal 3 being assembled, and FIG. 15 is a perspective view the connector terminal 3 being assembled, subsequent to FIG. 14.

In a process of fabricating the resilient piece 5, an electrically conductive metal sheet is punched into a predetermined shape, and then, bent into such a shape as illustrated in FIG. 12. Similarly to the above-mentioned terminal body 4, though FIG. 12 illustrates a portion of a metal sheet for fabricating singly the resilient piece 5, portions of a metal sheet for fabricating a plurality of the resilient pieces 5 are actually connected to one another through carriers 7. As illustrated in FIG. 13, after the resilient piece 5 illustrated in FIG. 12 is put on the metal sheet 4*a* illustrated in FIG. 10, the metal sheet 4*a* is bent at predetermined portions to thereby make the terminal body 4, as illustrated in FIG. 14, in which condition, the terminal body 4 and the resilient piece 5 are still connected to the carriers 6*a*, 6*b* and 7. Thereafter, the carriers 6*a*, 6*b* and 7 are cut away.

Figure 15:
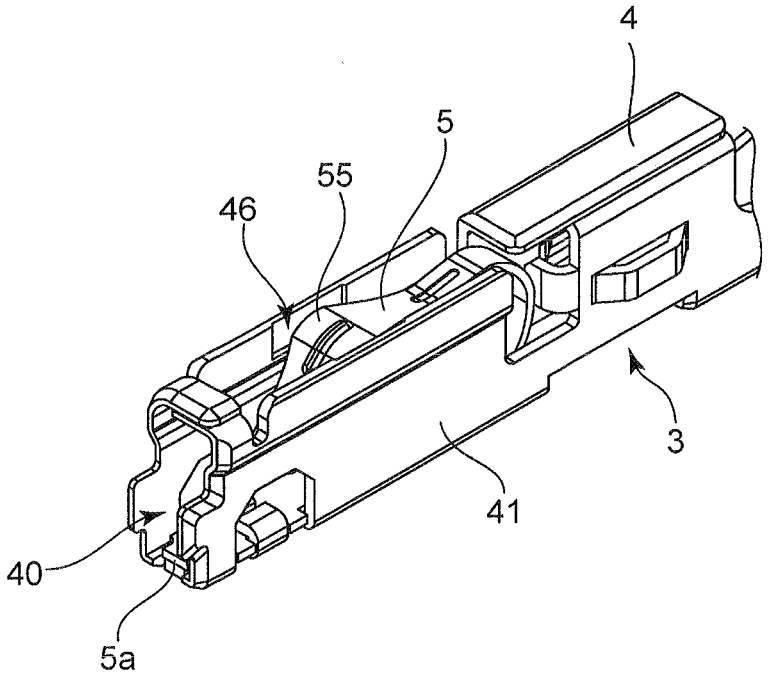
FIG. 15 is a perspective view of the connector terminal being assembled, subsequent to FIG. 14.

Thus, as illustrated in FIG. 15, there is completed the connector terminal 3 including the terminal body 4, and the resilient piece 5 fixed to the terminal body 4. In the connector terminal 3, since the resilient piece 5 is fixed to the terminal body 4 at a location close to the opening 40 of the terminal body 4, the resilient piece 5 can be readily assembled into the terminal body 4, and further, it is possible to cut away the carriers 7 of the resilient piece 5 after the resilient piece 5 has been assembled into the terminal body 4.

In addition, the resilient piece 5 and the terminal body 4 make contact with each other not through a plane-contact between a surface of the resilient piece 5 and a surface of the terminal body 4, but through a point-contact between a surface of the resilient piece and a summit of the projecting portion 44*a*, ensuring enhancement to reliability in the contact between the resilient piece 5 and the terminal body 4.

Figure 16A:
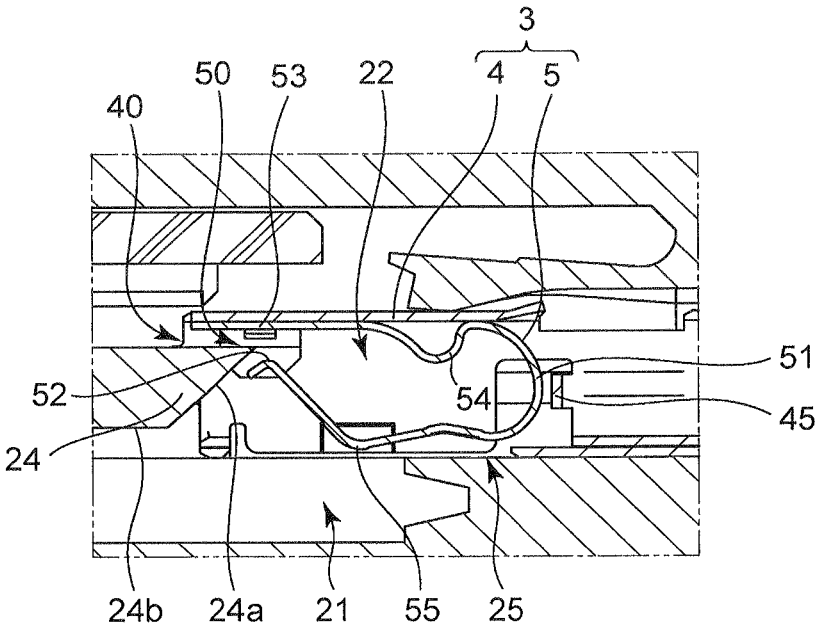
FIG. 16A is a cross-sectional view showing a positional relation between the connector terminal and the connector housing before the connector terminal is completely inserted into the connector housing.
Figure 16B:
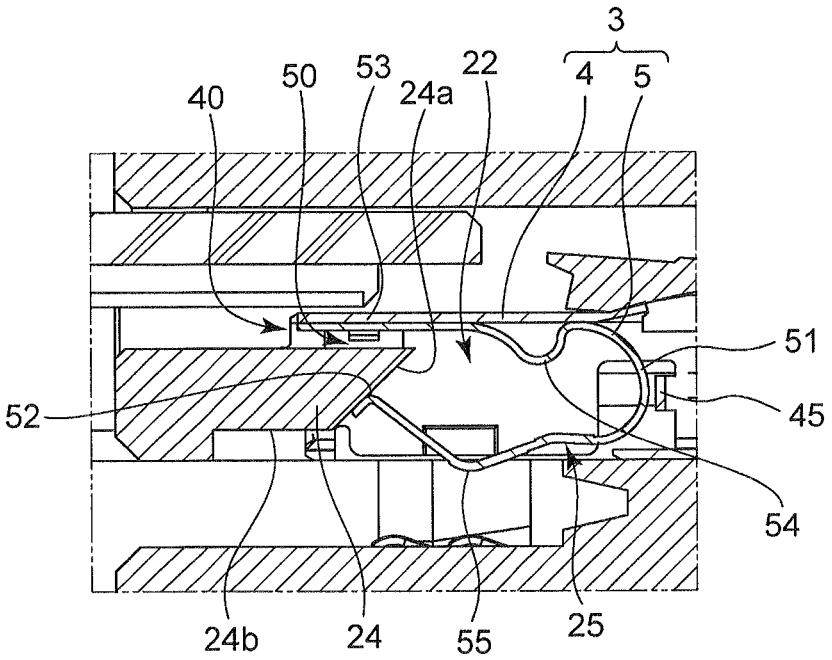
FIG. 16B is a cross-sectional view showing a positional relation between the connector terminal and the connector housing while the connector terminal is being inserted into the connector housing.

Hereinbelow is explained a process of assembling the connector terminal 3 into the connector housing 2 with reference to FIGS. 16A to 16C. FIG. 16A is a cross-sectional view showing a positional relation between the connector terminal 3 and the connector housing 2 before the connector terminal 3 is completely inserted into the connector housing 2, FIG. 16B is a cross-sectional view showing a positional relation between the connector terminal 3 and the connector housing 2 while the connector terminal 3 is being inserted into the connector housing 2, and FIG. 16C is a cross-sectional view showing a positional relation between the connector terminal 3 and the connector housing 2 after the connector terminal 3 has been inserted into the connector housing 2.

When the connector terminal 3 is inserted into the first space 22 through the opening 23 of the connector housing 2, as illustrated in FIG. 16A, the projection 24 enters the connector terminal 3 through the opening 40 of the terminal body 4, and the top surface 24*a* of the projection 24 faces the gap 50 of the resilient piece 5 housed in the terminal body 4. Further inserting the connector terminal 3, as illustrated in FIG. 16B, the sliding portion 52 of the resilient piece 5 makes contact with the tapered top surface 24*a* of the projection 24, and then, is pushed along the tapered top surface 24*a* towards the second space 21.

As a result, the contact portion 55 of the resilient piece 5 is forced to protrude into the second space 21 from the first space 22 through the opening 25.

Figure 16C:
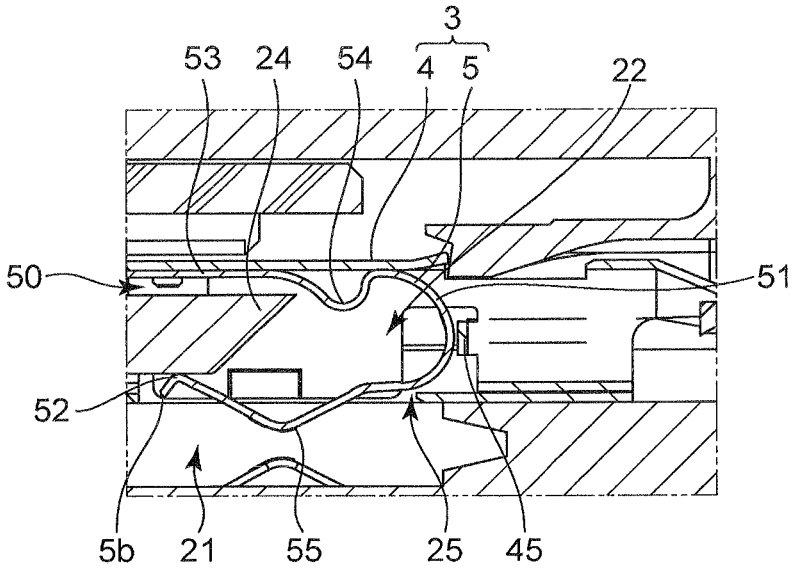
FIG. 16C is a cross-sectional view showing a positional relation between the connector terminal and the connector housing after the connector terminal has been inserted into the connector housing.

As illustrated in FIG. 16C, when the sliding portion 52 of the resilient piece 5 goes beyond a lower end of the taped top surface 24*a* of the projection and reaches a lower surface 24*b* of the projection 24, the contact portion 55 of the resilient piece 5 having protruded into the second space 22 through the opening 25 is put into such a condition that the sliding portion 52 can make contact with the terminal 240 formed on the circuit board 210 to be inserted into the second space 21.

Figure 17A:
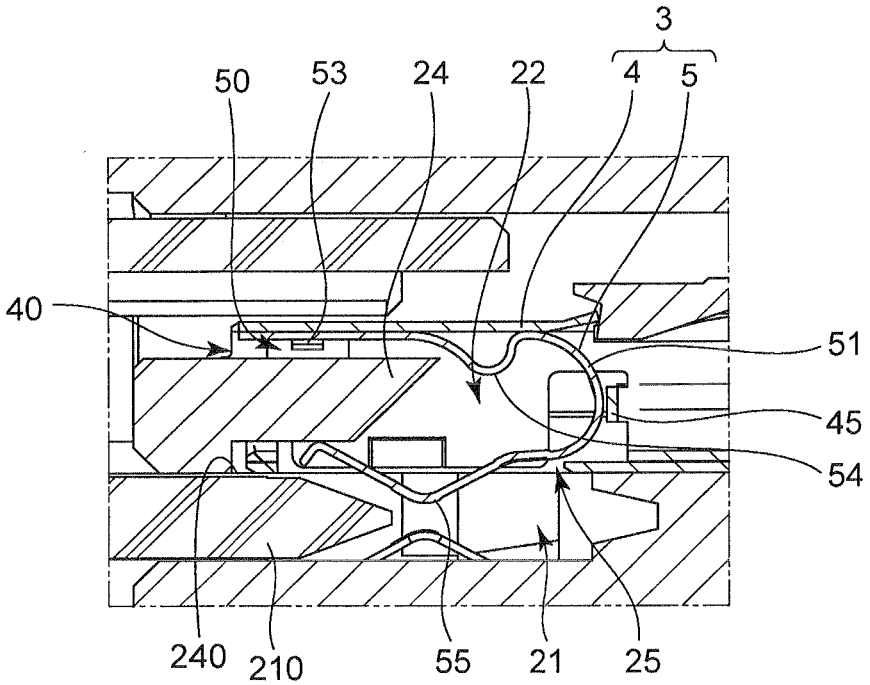
FIG. 17A is a cross-sectional view showing a positional relation between the connector and a circuit board before the circuit board is completely inserted into the connector housing.
Figure 17B:
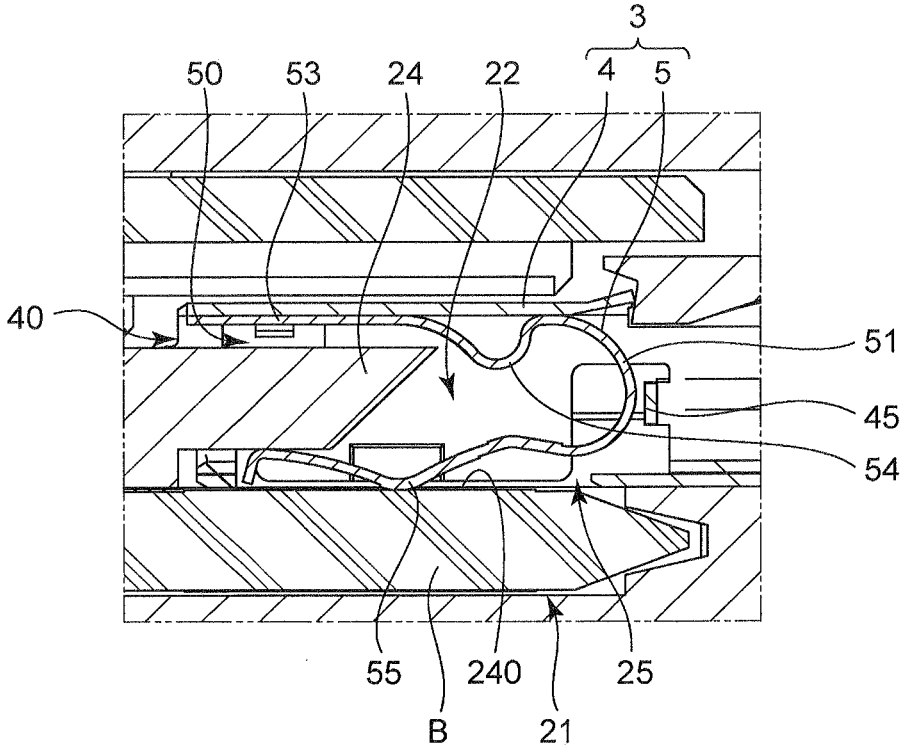
FIG. 17B is a cross-sectional view showing a positional relation between the connector and the circuit board after the circuit board has been inserted into the connector housing.
Figure 18:
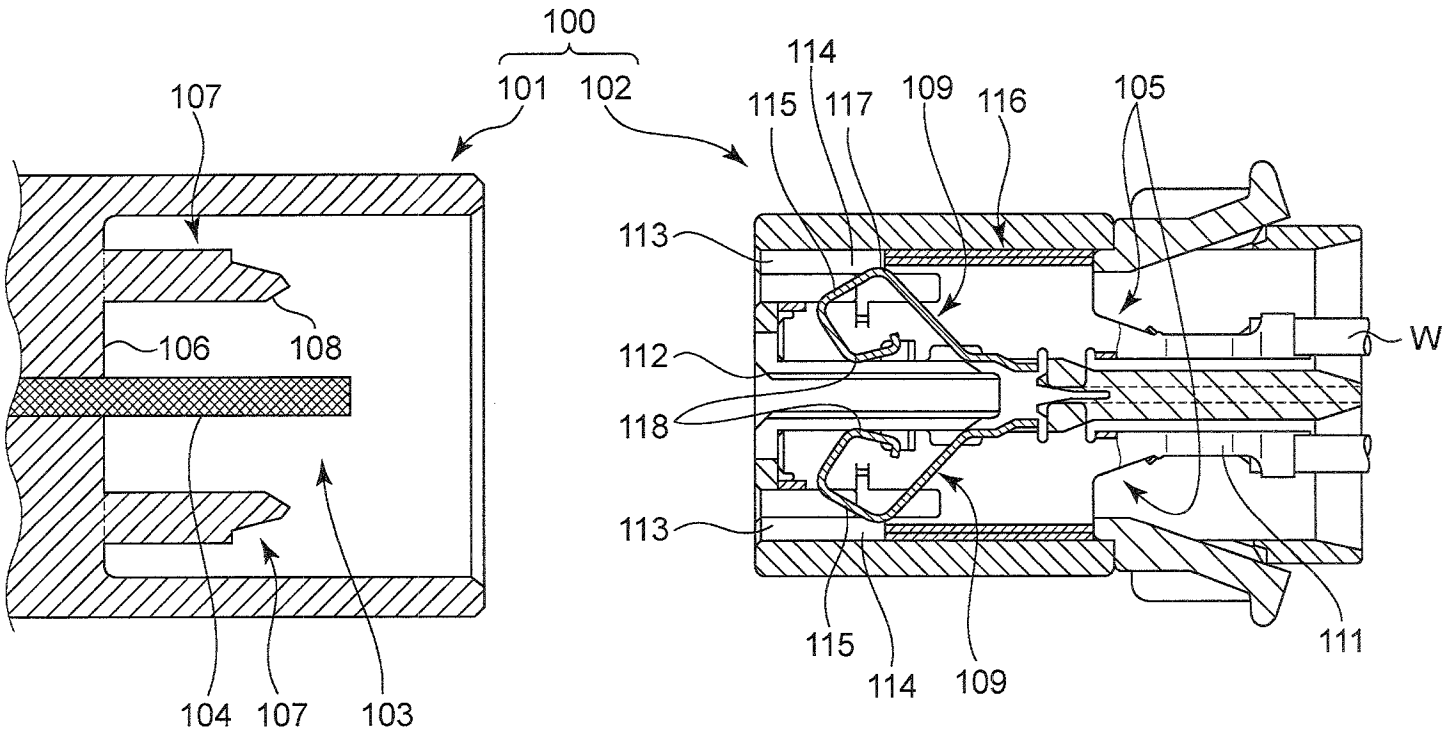
FIG. 18 is a cross-sectional view of two housings to be fit into each other in a conventional connector.
Figure 19:
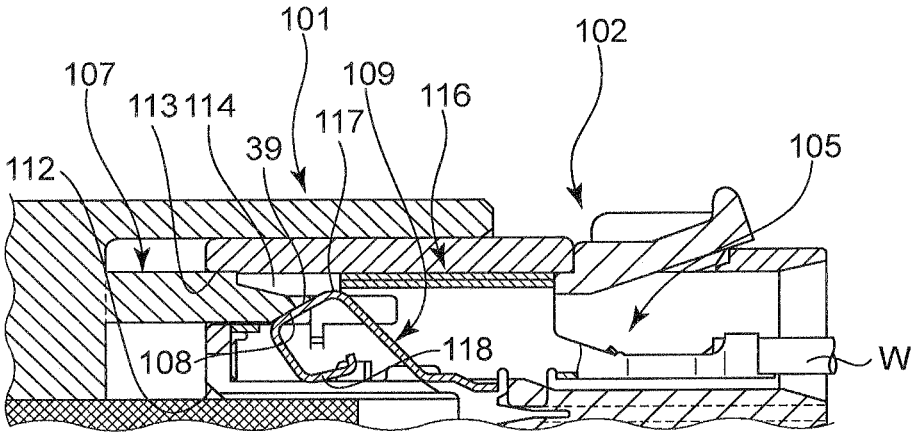
FIG. 19 is a perspective view of a step in a process of fitting the two housings illustrated in FIG. 18 into each other.
Figure 20:
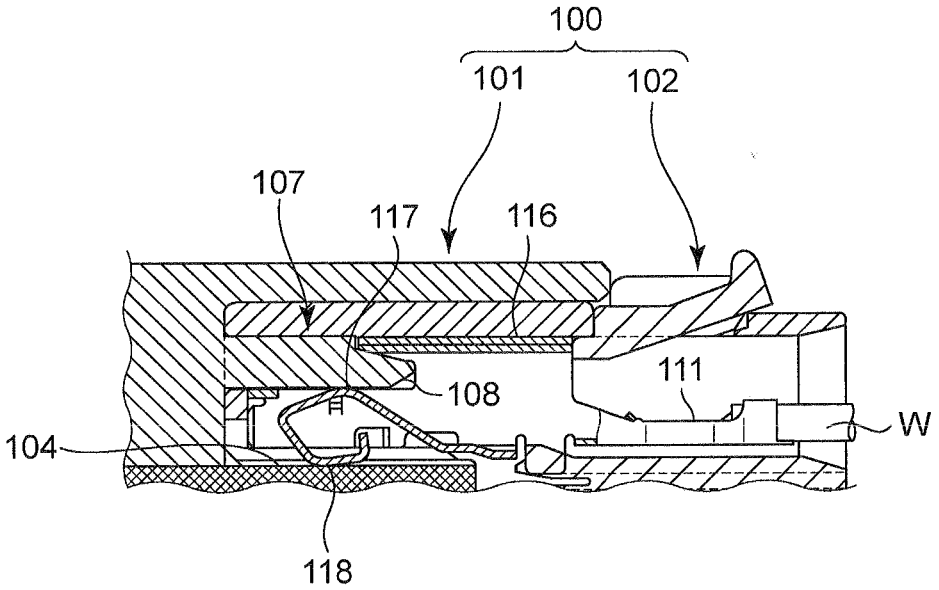
FIG. 20 is a perspective view of a step in a process of fitting the two housings illustrated in FIG. 18 into each other.

Hereinbelow is explained a process of assembling the circuit board 210 into the connector 1 assembled in the above-mentioned manner, with reference to FIGS. 17A and 17B. FIG. 17A is a cross-sectional view showing a positional relation between the connector 1 and the circuit board 210 before the circuit board 210 is completely inserted into the connector housing 2, and FIG. 17B is a cross-sectional view showing a positional relation between the connector 1 and the circuit board 210 after the circuit board 210 is inserted into the connector housing 2.

The housing 230 holding the circuit board 210 therein is inserted into the hood 20 of the connector housing 2 into which the connector terminal 3 is inserted. Thus, as illustrated in FIG. 17A, the circuit board 210 enters the second space 21 of the connector housing 2. Then, as illustrated in FIG. 17B, the contact portion 55 of the resilient piece 5 having protruded into the second space 21 through the opening 25 makes mechanical and electrical contact with the terminal 240 of the circuit board 210.

In the embodiment, the connector terminal 3 is inserted into the first space 21 of the connector housing 2 through the opening 23, and then, the contact portion 55 of the resilient piece 5 is pushed to thereby protrude into the second space 21 from the first space 22 through the opening 25. Thus, the contact portion 55 is in such a condition that the contact portion 55 is able to make contact with the terminal 240 of the circuit board 210 to be inserted into the second space 22 later. When the circuit board 210 is inserted into the second space 21, the contact portion 55 actually makes contact with the terminal 240 of the circuit board 210. Thus, if the terminal body 4 were designed to have a space in which the resilient piece 5 can be housed, it would be possible to have a space in the resilient piece 5 for allowing the projection 24 of the connector housing 2 to enter, which enables to down-size the connector terminal 3, and accordingly, the connector 1 housing the connector terminal 3 therein.

In the connector 1 in accordance with the embodiment, as having been explained so far, when the circuit board 210 is inserted into the second space 21 of the connector housing 2, the contact portion 55 of the resilient piece 5 protruding into the second space 21 through the opening 25 is pushed towards the first space 22, and hence, the first portion 51 of the resilient piece 5 is resiliently deformed. As a result, a reaction force brought by the first portion 51 ensures a high contact load between the contact portion 55 of the resilient piece 5 and the terminal 240 of the circuit board 210, in which case, since an inner stress of the resilient piece 5 is divided into three sections, specifically, the contact portion 55, the first portion 51, and the curved portion 54, the resilient piece 5 is prevented from being plastically deformed, and hence, the connector terminal 3 can have enhanced durability. If the resilient piece 5 is designed not to include the curved portion 54, since the flat second portion 53 makes close contact with an inner surface of the terminal body 4, an inner stress of the resilient piece 5 is divided into only two sections, specifically, the contact portion 55 and the first portion 51. Accordingly, the resilient piece 5 without the curved portion 54 would have a maximum stress greater than the same of the resilient piece 5 having the curved portion 54.

When the circuit board 210 is inserted into the second space 2*l* of the connector housing 2, the contact portion 55 of the resilient piece 5 is pushed towards the first space 22 or the opening 25 from the second space 21, specifically, pushed into the condition illustrated in FIG. 17B from the condition illustrated in FIG. 17A. As a result, though the curved or arcuate first portion 51 is forced to retreat towards the opening 23, the stopper 45 situated at a rear of the sheath portion 41 prevents retreat of the first portion 51 of the resilient piece 5. Thus, the distal end 5*b* and the sliding portion 52 of the resilient piece 5 are prevented from being pulled into the second space 21 to thereby be buckled when the circuit board 210 is inserted into the second space 21, ensuring enhancement in reliability to the contact between the connector terminal 3 and the circuit board 210.

INDUSTRIAL APPLICABILITY

The present invention is useful to a connector terminal and a connector both used for electrical connection between devices equipped in an automobile and so on.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-133015 filed on Jun. 27, 2014, respectively, each including specification, claims, drawings and summary is incorporated herein by reference in its entirety.

What is claimed is:

1. A connector terminal to be inserted into and housed in a connector housing, said connector housing including;

a first space having an opening through which said connector terminal is inserted thereinto; and a second space into which a circuit board is fit, said second space being situated adjacent to said first space, said connector terminal including;

a terminal body having an opening at a front in a first direction in which said connector terminal is inserted into said first space; and a resilient piece to be housed in said terminal body, said resilient piece defining a loop between ends thereof such that a gap is formed between said ends thereof, said resilient piece being housed in said terminal body such that said gap faces said opening of said terminal body, said resilient piece being fixed at one of said ends thereof to said terminal body, said resilient piece including a contact portion resiliently protruding into said second space from said first space, said connector housing including a projection projecting in a second direction opposite to said first direction, and being insertable into said terminal body through said opening of said terminal body, said connector housing being formed with an opening between said first and second spaces, said contact portion being able to pass through said opening, said resilient piece including a sliding portion at the other end thereof, the sliding portion being slidable on said projection when said connector terminal is inserted into said first space, said contact portion being caused to protrude into said second space from said first space through said opening when said sliding portion slides on said projection.

2. The connector terminal as set forth in claim 1, wherein said resilient piece includes:

a curved first portion;

a second portion extending from one of ends of said first portion and having a free distal end; and a third portion extending from the other end of said first portion and having a free distal end, said contact portion being formed at said third portion so as to outwardly protrude in a V-shape, said third portion being formed such that a part thereof including said free distal end thereof is inclined towards said second portion so as to form the gap between said free distal end thereof and said free distal end of said second portion.

3. The connector terminal as set forth in claim 2, wherein said part of the third portion including the free distal end thereof is curved in a V-shape.

4. The connector terminal as set forth in claim 2, wherein said second portion includes a curved portion between a distal end thereof and said first portion, said curved portion protruding towards said third portion.

5. The connector terminal as set forth in claim 1, wherein either one of said terminal body and said resilient piece is formed with a raised portion, said raised portion of said terminal body being in facing relation with said one of ends of said resilient piece when said resilient piece is fixed at said one of said ends to said terminal body, said raised portion of said resilient piece being in facing relation with said terminal body when said resilient piece is fixed at said one of said ends thereof to said terminal body.

6. The connector terminal as set forth in claim 1, wherein said terminal body includes a stopper restricting movement of said resilient piece in said second direction.

7. A connector including a connector housing and a connector terminal, said connector housing including:

a first space having an opening through which said connector terminal is inserted thereinto; and a second space into which a circuit board is fit, said second space being situated adjacent to said first space, said connector terminal being inserted into and housed in said first space through said opening, said connector terminal including:

a terminal body having an opening at a front in a first direction in which said connector terminal is inserted into said first space; and a resilient piece to be housed in said terminal body, said resilient piece defining a loop between ends thereof such that a gap is formed between said ends thereof, said resilient piece being housed in said terminal body such that said gap faces said opening of said terminal body, said resilient piece being fixed at one of said ends thereof to said terminal body, said resilient piece including a contact portion resiliently protruding into said second space from said first space, said connector housing including a projection projecting in a second direction opposite to said first direction, and being insertable into said terminal body through said opening of said terminal body, said connector housing being formed with an opening between said first and second spaces, said contact portion being able to pass through said opening, the other end of said resilient piece being slidable on said projection when said connector terminal is inserted into said first space, said contact portion being caused to protrude into said second space from said first space through said opening when said other end thereof slides on said projection.

* * * * *